United States Patent [19]

Moos et al.

[11] 4,324,361

[45] Apr. 13, 1982

[54] METHOD OF ATOMIZATION AND ATOMIZING DEVICE FOR COATING MATERIAL USING THE COANDA EFFECT

[75] Inventors: Kurt Moos, Wil; Karl Buschor, St. Gallen, both of Switzerland

[73] Assignee: GEMA AG Apparatebau, Switzerland

[21] Appl. No.: 98,345

[22] Filed: Nov. 29, 1979

[30] Foreign Application Priority Data

Dec. 4, 1978 [DE] Fed. Rep. of Germany ..... 2852412
Jun. 9, 1979 [DE] Fed. Rep. of Germany ..... 2923451

[51] Int. Cl.[3] ..... B05B 5/00; B05B 7/00; B05B 7/10

[52] U.S. Cl. ..... 239/3; 239/11; 239/706; 239/292; 239/301; 239/406; 239/DIG. 7

[58] Field of Search ..... 239/1, 3, 8, 11, 690, 239/692, 290, 292, 300, 301, 405, 406, 420, 426, 433, 434, DIG. 7

[56] References Cited

U.S. PATENT DOCUMENTS 1,559,625 11/1925 Kutis ..... 239/405
2,361,144 10/1944 Loepsinger ..... 239/8
2,988,139 6/1961 Coanda ..... 239/433 X
3,248,606 4/1966 Fraser .
4,171,096 10/1979 Welsh et al. ..... 239/301 X
4,225,090 9/1980 Kako et al. ..... 239/692

FOREIGN PATENT DOCUMENTS 1577760 3/1970 Fed. Rep. of Germany .
2030388 4/1976 Fed. Rep. of Germany .
1752027 9/1976 Fed. Rep. of Germany .

*Primary Examiner*—Andres Kashnikow
*Attorney, Agent, or Firm*—Ostrolenk, Faber, Gerb & Soffen

[57] ABSTRACT

An atomizer has a channel through which material to be atomized, preferably comprising a transport gas and a powder, liquid or granular material, flows in a first direction. At or slightly downstream from the downstream end of the channel, preferably an atomizer gas is injected into the stream to be atomized, the injection occurring at an angle to the first direction. Preferably the atomizer gas is injected to impart a rotary motion to the stream. At the downstream end of the channel is a funnel-shaped outlet whose surface is so shaped that the stream can adhere to the interior surface of the outlet under the Coanda effect, producing an atomized cloud of transversely uniform density. A gas jacket may be used to control the shape of the cloud. The flow of both the atomizer gas and the gas forming the gas jacket is preferably adjustable in speed and direction.

28 Claims, 8 Drawing Figures

FIG.3
(PRIOR ART)
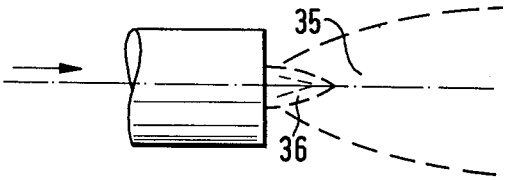
FIG.4
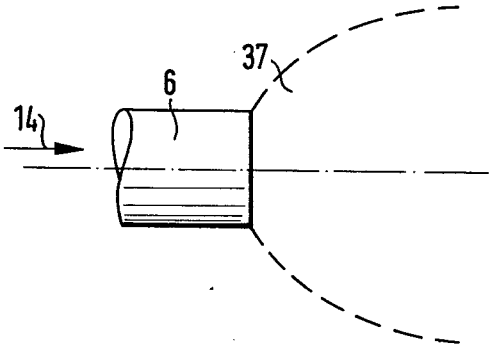
FIG.5
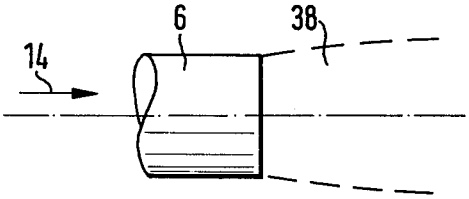
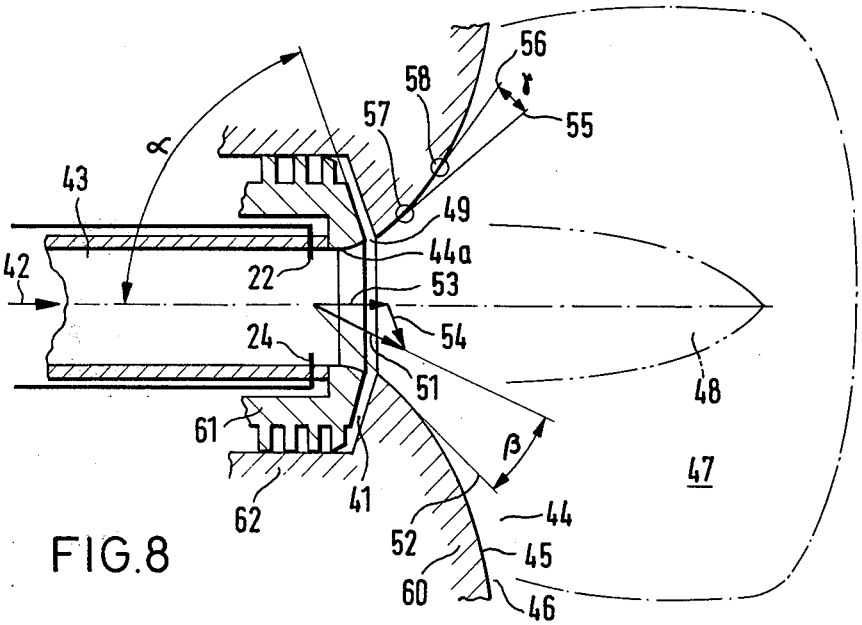
FIG.8

METHOD OF ATOMIZATION AND ATOMIZING DEVICE FOR COATING MATERIAL USING THE COANDA EFFECT

BACKGROUND OF THE INVENTION

The present invention relates to a method and apparatus for atomizing atomizable coating material, such as a powdered coating material, and relates particularly to such a method and apparatus in which atomizable material is expelled from an atomizable material transmission channel through a funnel-shaped orifice without need for insertion of an additional body into the flow of material to shape the cloud of atomizable material by deflecting it.

Devices of this type are known from West German Provisional Patent (Auslegeschrift) No. 14 27 642 and West German Unexamined Application for Patent (Offenlegungsschrift) No. 17 77 284. In them, a swirl chamber is provided between the atomizable material channel and the funnel-shaped orifice to the exterior. A gas channel for injecting a gas, normally air, into the powdered atomizable material, for causing eddies in the powder, discharges into the swirl chamber near to but not directly at the entrance of the orifice. The actual atomization in such known arrangements takes place further downstream and is due to the turbulence produced at a sharp mouth edge provided in the orifice. In this way, however, only a very narrow jet of atomized material can be produced. If, as in most cases, a wider, more diffuse cloud of powdered atomizable material, is needed to be expelled from the orifice, inserts must be provided in the orifice, as shown in FIGS. 3 to 5 of the above-mentioned German Application No. 17 77 284, to deflect the atomizable material into a cloud of the desired shape. Atomizing atomizable material such as a powder by the use of baffle plates in the flow of material is known from West German Unexamined Application (Offenlegungsschrift) No. 15 77 760 and West German Pat. No. 17 52 027.

West German Pat. No. 20 30 388 discloses charging atomizable material electrostatically so that it is attracted by the object which is to be coated and thus adheres better to it, with less of the atomizable material being lost.

SUMMARY OF THE INVENTION

The present invention is directed toward atomizing atomizable material, and particularly powdered coating material, so as to form a cloud which has a substantially uniform density transverse to the direction of flow and so that the speed of axial propagation of the cloud is substantially less than the axial speed of the unatomized material passing toward the atomizing device. Moreover, it is desired to avoid deposits of atomized material on and in the atomizing device.

It is accordingly the principal object of the present invention to provide a method and an apparatus for forming a cloud of atomized material, which cloud has any desired size and shape.

It is another object of the invention to form such a cloud without the use of additional bodies or guide surfaces inserted into the stream of atomizable material.

It is another object of the present invention to provide such a method and apparatus that can be used with atomizable materials, including powders, granulated substances, and liquids, including paints.

It is a further object of the present invention to provide means for spraying atomizable materials without creating deposits thereof on or in the atomization device.

It is still another object of the present invention to achieve the foregoing objects by means of a device that can be removably attached to a source of atomizable material, to allow easy cleaning and maintenance.

A stream of an atomizable material is borne by a gas, such as air, through a flow channel according to the present invention; and a second stream of atomizer gas is injected into the stream of atomizable material. The injection of the atomizer gas introduces rotational motion into the atomizable material and helps to atomize it. The stream of atomizable material into which the atomizer gas stream has been injected is then sprayed out through a funnel-shaped orifice or outlet section which is defined by an interior surface that is flared outward in the direction of the flow. Preferably, that interior surface is curved outwardly moving downstream so as to cause the stream of atomizable material to adhere to the interior surface substantially without turbulence, in accordance with the Coanda effect, described below.

The Coanda effect is based on the phenomenon that jets of liquid and gas which are flowing past a surface under certain conditions, are deflected toward that surface and adhere to it. A jet of fluid normally has the tendency to continue to flow in a straight line. It entrains particles of gas or liquid which are located between it and the surface, creating a vacuum between the jet and the surface. This vacuum deflects the jet toward the surface. The surface need not be parallel to the axis of the jet for the Coanda effect to occur. The angle between the surface and the axis of the jet can be as great as about 30°, but is preferably about 7°.

The application of the Coanda effect to a stream of atomizable material will not itself produce the desired atomization of the material. In accordance with the invention, as noted above, the stream of atomizable material is driven through a channel that has a downstream outlet section which flares in a funnel-shape, becoming progressively wider in the direction of flow. The interior wall of the outlet section of the channel is formed at such a large angle to the outer, generally cylindrical, surface of the stream of atomizable material that the Coanda effect cannot occur spontaneously. By the introduction of a stream of atomizer gas at an acute angle to the direction of flow of atomizable material, the stream of atomizable material is dispersed radially in the channel outlet section to such an extent that the outer surface of the stream of atomizable material experiences the Coanda effect with the funnel-shaped interior wall of the outlet section.

In this way, a cloud of atomizable material is produced having a substantially uniform density over its entire cross-section transverse to the downstream direction which is the direction of axial expansion of the cloud. Furthermore, the speed of axial expansion of the cloud is substantially less than the axial speed of the unatomized material moving through the channel. As a result, the atomizable material adheres better to the objects to be coated, since its impact on the objects is smaller.

In accordance with the present invention, by the avoidance of the use of any inserts in the outlet section of the channel to shape the cloud of atomizable material by deflecting it, the cloud completely fills up the funnel-shaped outlet section of the channel. The cloud has neither any holes nor any pronounced jet core for several centimeters after emergence from the channel. The cloud has substantially the same density in its interior as in the region of its boundary. Thus, shorter surface coating times and more uniform surface coating result since a sprayed coating region is covered uniformly with atomizable material.

In a preferred embodiment of the present invention, the outlet from the separate atomizer gas channel is placed directly at the upstream end of the outlet section of the channel for atomizable material. The interior wall of the outlet section widens continuously and progressively in the direction of flow, commencing at the location of the outlet of the atomizer gas channel. In this embodiment, the powdered atomizable material has not yet been subjected to any substantial expansion effect at the point at which the atomizer gas is injected. As noted above, the outlet section of the channel and the atomizable material flow path are free of inserts or bodies intended as guide surfaces for the atomizable material.

By use of the present invention, there is no need to use inserts which could lead to the formation of deposits. In the devices of the prior art, there is the danger that the deposits on the inserts in the flow path will be entrained in the flow, preventing a satisfactorily even coating on an object. According to the invention, the coating mixture flows along the interior wall surface of the funnel-shaped outlet section without reversal eddies, so that dirtying of the outer surfaces of the apparatus is also avoided.

With the device of the invention, atomizable material can be expelled either in a relatively narrow, jet shape or in the form of a relatively large cloud. This range is obtainable because the cone angle of the funnel-shape of the outlet section of the channel can be selected from a relatively wide range without impairing favorable atomizing action. This is probably because the swirling effect of the atomizer gas and the diffusion effect occur at the same time and place, and a continuous diffusion effect is then added, all the way to the downstream end of the mouthpiece opening.

The angle which the interior wall surface of the outlet section makes with a plane perpendicular to the axis of the atomizable material channel is preferably less than 65° at the upstream end of the outlet section and 0° or more at the point farthest downstream in the outlet section that can still be contacted by outflowing atomizable material. An angle of at most 50° at the upstream end of the outlet section is particularly suitable.

It is particularly advantageous to develop the outlet of the atomizer gas channel as an annular slot which surrounds the path of flow of the atomizable material and is disposed at or slightly downstream from the upstream end of the outlet section. In this way, a uniform swirl effect of the atomizer gas over the entire periphery of the stream of atomizable material is assured.

The invention is not limited to the atomization of powders but can be employed in general for atomizing liquids and coloring materials, including paints. This can be done by arranging one or more slot nozzles, in addition to the atomizer gas channel outlet, coaxial with and surrounding the periphery of the channel carrying the coloring-substance (powder or liquid) to supply a gas jacket of control gas to cover and shape the exterior of atomized cloud of coloring substance. In order to obtain a uniform gas jacket, the slot nozzle should preferably be annular.

The slot nozzle is preferably adjustable. A maximum diameter of the gas jacket is obtained when the slot nozzle is located at the downstream end of the outlet section of the atomizable material channel. The control gas, preferably air, that is expelled by the slot nozzle flows essentially in the same direction as the cloud of coloring material. A sharply defined cloud of coloring material can be obtained by means of the jacket of control gas without the use of any mechanical bodies inserted into the flow path of the atomizable material. Due to the gas jacket of the control gas, not only can sharp boundaries between coated and uncoated areas on the object to be coated be obtained, but color particles are also prevented from being lost from the cloud of coloring substance. Depending on the adjustment of the slot nozzle, a thick or a thin-walled cylindrical or conical gas jacket and a cloud of coloring material of a corresponding shape contained therein can be produced.

The part including the outlet section of the channel, which either contains the part having the funnel-shaped interior wall surface or itself forms this surface, is connected, preferably in a detachable and insertable manner, with the remainder of the atomizer device. In this way, it is possible to use, as desired, outlet sections having different interior wall funnel curvatures. A large curvature results in a cloud of atomizable material having a comparatively large cross-section, while a small curvature produces a jet-shaped cloud of powder.

One or more electrodes for the electric or electrostatic charging of the atomizable material and disposed at or slightly downstream from the upstream end of the outlet section of the channel can be arranged in a known manner in the flow path of the atomizable material and be disposed at or slightly downstream from the upstream end of the outlet section. Electric connection elements are located at the point of connection of the part that forms the funnel-shaped interior wall surface to form an electric connection for electrodes for electric charging of the atomizable material, e.g. powder. In this way, the electric parts are readily accessible.

Other objects and features of the present invention will be apparent from the following detailed description of several preferred embodiments taken in conjunction with the drawings.

BRIEF DESCRIPTION OF THE DRAWINGS

FIG. 3 is a diagrammatic view of a cloud of material produced with known devices for atomizing liquids;

FIGS. 4 and 5 show clouds of atomized material produced with the apparatus of the invention;

FIG. 8 is an axial section of a portion of another embodiment of atomization device in accordance with the invention.

DETAILED DESCRIPTION OF THE INVENTION

Figure 1:
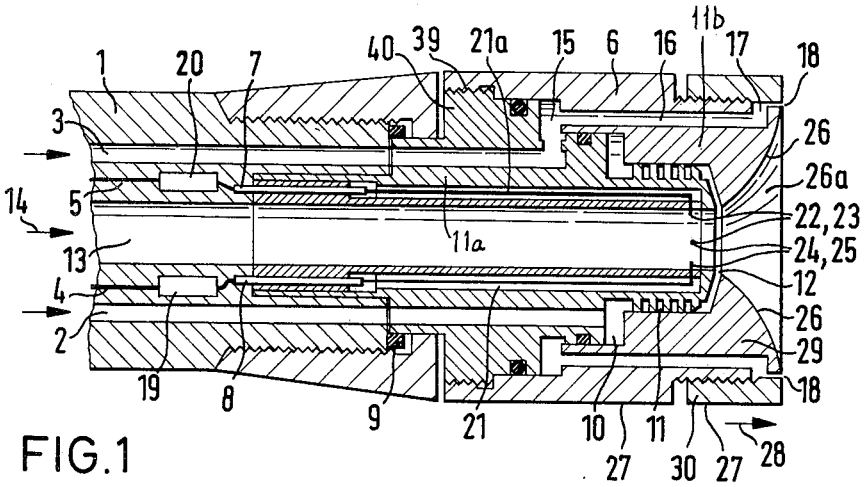
FIG. 1 is a partial axial section through an atomization device in accordance with the invention.

One embodiment of an atomization device is shown in FIG. 1. It can have the shape of a spray gun 1, only a part of which is shown. It contains a first atomizer gas channel or bore 2 extending axially through it. The spray gun has a separate second control gas channel or bore 3 also extending axially through it. It also contains high voltage lines 4 and 5. At the joint of the plug connection, there are electric pins 7 and 8 of the high voltage lines 4 and 5. An atomizer mouthpiece 6 at the outlet section of the below described channel for atomizable material is detachably fastened, for instance by a plug connection, to the spray gun body 1. At the transition from the atomizer gas channel 2 to the mouthpiece 6, there is a seal 9.

The atomizer gas, which is normally air, is conducted through the channel 2 and is discharged into an annular chamber 10 located upstream from the outlet section for atomizable material. Adjoining and immediately downstream from the chamber 10 is a spiral channel section 11 within which the atomizer gas from channel 2 is brought into a rotating movement. The spiral channel section 11 is defined by a flat thread formed in sleeve 11*a* of the outlet section for atomizable material and a smooth cylindrical wall on the sleeve 11*b* coaxially adjoining the exterior of sleeve 11*a* of the outlet section for atomizable material. The channel section 11 causes the atomizer gas to flow with a tangential component of motion out of an annular slot 12 that is directed to cut radially inwardly through the sleeve 11*b*. The atomizer gas imparts a swirl or eddy motion to the stream of atomizable material 14, which is fed via the large central channel 13. In this way, atomization is commenced. The atomizable material 14 in this embodiment comprises a propellant gas, normally air, which serves as a transport carrier, and powdered or granular coating material that is transported by the propellant gas. The axial velocity component of the atomization material fed from the channel 13 is substantially decreased by the flow of atomizer gas from the slot 12.

It should be noted that the annular slot 12 can be formed as the gap between an outer mouthpiece part 29 and the downstream end of atomizable material channel 13, which downstream end is a portion of an inner mouthpiece part 40. The outer mouthpiece part 29 can be screwed onto the inner mouthpiece part 40 via a thread 39 in an axially adjustable manner. As a result of this arrangement, the axial size of the annular slot 12 from which the atomizer gas issues can be varied.

A separate second flow of a control gas, also preferably air, is introduced through the control gas channel 3 into an annular chamber 15 from which a plurality of axial boreholes 16 discharge into a second annular chamber 17. The control gas passes from chamber 17 into an annular slot 18. The outlet from slot 18 is downstream from the outlet section of the channel 13. Depending on the quantity of control gas which emerges from slot 18 and the angle at which the gas is caused to emerge from the slot 18, the diameter and the atomization angle, respectively, of the cloud of atomizable material which emerges at the end of the channel 13 via a funnel-shaped outlet section 26*a* can be enlarged or reduced in size. The outlet section 26*a* is the downstream orifice of a generally funnel-shaped interior wall 26 of sleeve 11*b*. Wall 26 widens continuously and progressively from its upstream end to its downstream end.

Figure 2:
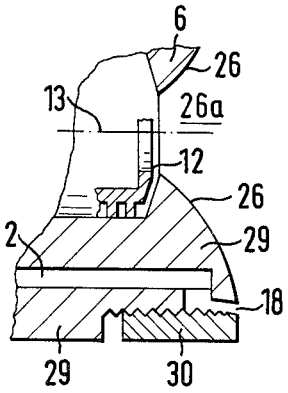
FIG. 2 shows a detail of FIG. 1 on a larger scale.

As shown in FIG. 2, the annular slot 18 by which the control gas is emitted can be formed as an annular gap between the outer mouthpiece part 29, which includes the interior wall 26 of the outlet section 26*a*, and an adjustably screwed-on outer ring 30 attached outside the part 29. By axial displacement of the outer ring 30 with respect to the mouthpiece part 29, the cooperating surfaces of the parts 29 and 30 forming the annular slot 18 are displaced relative to each other, so that the size and shape of the slot 18 can be adjusted. This changes the speed and the direction of the flow of control gas with respect to the cloud of atomized material emerging from the orifice of outlet section 26*a*.

The atomizable material can be electrostatically charged in a known manner. (See West German Unexamined Application for Patent (Offenlegungsschrift) No. 20 30 388.) The high voltage lines 4 and 5 necessary for this are connected to the pins 7 and 8 via two protective resistors 19 and 20. In this way, high voltage is supplied to lines 21 and 21*a*, the ends of which form charging electrodes 22–25.

The use of rotating air emerging from an annular slot for the atomizing of paints or other atomizable materials is known. The known device using such a slot, however, does not have a diverging funnel-shaped outlet opening. As a result, an atomization jet 35 as shown in FIG. 3 is produced using a known device. The atomized liquid jet 35 contains a dense jet core 36 in the region near the device.

In the device according to the invention, in contrast to the prior art, the atomizer gas in channel 2 is injected into the flow of atomizable material 14 in such a manner that the flow 14 applies itself against the interior wall 26 of the funnel-shaped outlet section 26*a*. With this type of operation, movement of air in the direction indicated by the arrow 28 is developed on the outer surface 27 of the mouthpiece 6. In this way, powder or paint is prevented from being deposited on the surface 27. Such deposited powder would fall at periodic intervals in the form of clots of powder onto the object to be coated.

The powder cloud 37 of atomizable material produced by the device of FIG. 1 has the shape shown in FIG. 4 when it is allowed to spread out unimpeded. Control air expelled via the annular slot 18 can deform the cloud into the shape 38 shown in FIG. 5. This shape 38 of cloud is desireable in those cases where it is necessary for the spray to penetrate to a remote or relatively inaccessible surface, for instance for internally coating a channel iron. This procedure also makes it possible to a certain extent to overcome the Faraday cage.

The size and shape of the cloud of atomized material is also influenced by the exact shape of the interior wall 26 of the outlet section 26*a*. Different mouthpiece parts 29 having different angles between the interior wall 26 and a plane 13*a* perpendicular to the axis of the part 29 can be attached to the atomizable material channel 13 to produce clouds of different shapes and sizes.

With the construction in accordance with the invention, the stream 14 of atomizable material, after injection of atomizer gas from channel 2, tends to adhere to the bell-shaped or funnel-shaped surface 26 because of the Coanda effect, described above. If this surface 26 were facing rearward or upstream against the direction of flow of the atomizable material, rather than forward or downstream, a portion of the cloud would be reflected toward the rear, contrary to the original direction of flow. Such an effect occurs particularly in the atomization of paints and other liquids when a body is inserted into the path of flow of atomizable material 14 to produce atomization. But this is very undesirable since the entire front part of the spray device is then coated with paint. In order to avoid this problem, control gas expelled from the annular slot 18 can be employed as described above in order to prevent the soiling of the device with reflected paint.

Figure 6:
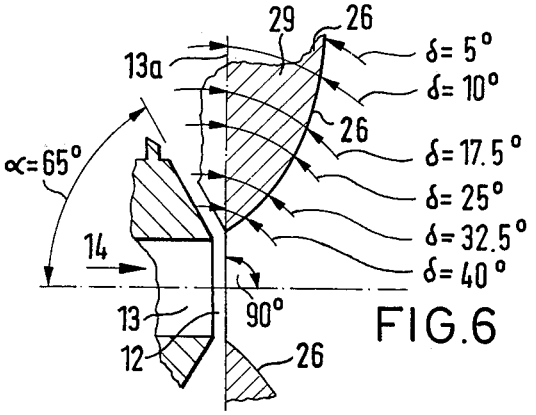
FIG. 6 is an axial section of one preferred outlet section of an atomizable material channel, in accordance with the invention.
Figure 7:
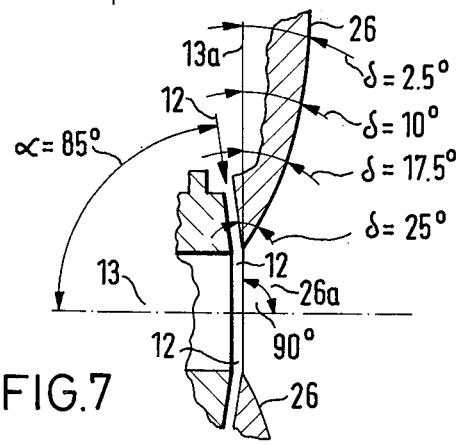
FIG. 7 is an axial section of another preferred outlet section of an atomizable material channel, in accordance with the invention.

The angular relationships shown in FIGS. 6 and 7 have proven particularly favorable in practicing the present invention. With an angle $\alpha$ of about 65° between powder channel 13 and the mouth end of the atomizer gas slot 12, the angle $\delta$ between the interior surface 26 and a plane 13*a* perpendicular to the axis of the main channel 13 in accordance with FIG. 6 varies preferably between about 40° at the upstream end of the funnel 26*a* and 0°, but is preferably about 5°, at the downstream end of the funnel-shaped opening 26*a*. With an angle $\alpha$ of about 85°, the angle $\delta$ in accordance with FIG. 7 varies preferably between about 25° at the upstream end and 0°, but is preferably about 2.5° at the downstream end of the funnel-shaped opening 26*a*.

In the embodiment shown in FIG. 8, an atomizer gas channel 41 obliquely discharges gas at an angle $\alpha$ of about 65° into the flow path of powdered atomizable material 42 which flows via a channel 43 into a funnel-shaped channel outlet section 44. The narrow end 44*a* of outlet section 44 is located at the downstream end of the channel 43. The section of the interior funnel wall 45 between its narrow end 44*a* and the annular outlet 49 of the atomizer gas channel 41 need not be a continuous surface, as will be explained below. The curvature of the interior funnel wall 45 is such that the Coanda effect occurs, as a result of which the flow of atomizable material 42 adheres to the interior funnel wall 45 up to a desired outlet point 46. If cloud 47 of atomized material of uniform density without a pronounced jet core (such as the core 48 shown in phantom) is to be produced by means of the device shown in FIG. 8, then the angle $\beta$ between the resultant momentum vector 51 of the atomizable material 42 after injection of the atomizer gas from gas channel 41 and a tangent 52 to the most proximate region of the interior funnel wall 45 must be at most 30°. Angle $\beta$ is preferably, however, between 6° and 10°.

The momentum vector 51 is the resultant of the axial momentum vector 53 of an element of the atomizable material 42 before injection of the atomizer gas and the momentum vector 54, directed toward the funnel wall 45, of the atomizer gas as it emerges from the channel 41. In other words, the Coanda effect enters into play when the angle $\beta$ between the outer surface of the stream of material which is driven radially apart by the atomizer gas and the upstreammost portion of the interior funnel wall 45 is no more than 30°. Angle $\beta$ is preferably only 7°. The atomizable material in this embodiment comprises powdered material and a gas as transport carrier. Downstream from the slot-shaped outlet 49 of the atomizer channel 41, the curvature of the interior funnel wall 45 is such that the tangents 55 and 56 at two points 57 and 58 of the wall 45 which are arranged one behind the other in the direction of flow form an angle $\gamma$ of less than 30°. This angle $\gamma$ is preferably between 6° and 10°, and about 7° is especially advantageous.

In the embodiment of FIG. 8, the outlet 49 of the atomizer gas channel 41 interrupts the curvature of the upstream region of the interior funnel wall 45, while in the embodiment of FIG. 1 the outlet is between the downstream end of the channel 13 and the upstream end of the outlet section 26*a*. Otherwise, the atomizer gas channel 41 of FIG. 7 corresponds to the channel 2, 11 of FIG. 1. The interior funnel wall 45 is the terminus of a mouthpiece part 60 which is connected in axially adjustable manner via a thread (not shown), similar to the thread 39 of FIG. 1, to an inner mouthpiece part 61. The two parts 60 and 61 together form a mouthpiece 62 which corresponds essentially to the mouthpiece 6 of FIG. 1. By axial displacement of the outer part 60 with respect to the inner part 61, the width of the annular slot-shaped outlet 49 of the atomizer gas channel 41 can be varied.

By the Coanda effect, strong friction can be obtained between the atomizable material 14 or 42 and the wall 26 or 45 of the funnel-shaped outlet section 26*a* or 44, respectively. This friction can be used to produce frictional electricity, by which the atomizable material can be so strongly charged that charging electrodes 22–25 can be dispensed with. For this purpose it is necessary that the outer mouthpiece part 29 or 60 forming the outlet section 26*a* or 44, respectively, have a substantially different specific electric voltage potential than the atomizable material 14 or 42. For instance, polytetrafluorethylene, known by the trademark Teflon, is suitable for the parts 29 and 60 in the case of an epoxy atomizable material and polyester is suitable for those parts in the case of atomizable material made of an acrylic resin, e.g. methylmethacralate.

Although several preferred embodiments of the invention have been described in detail, many modifications and variations thereof will now be apparent to one skilled in the art. Accordingly, the scope of the present invention is to be limited not by the details of the preferred embodiments herein described but only by the terms of the appended claims.

What is claimed is:

1. A method for atomizing a material, comprising the steps of:

providing a stream of a material to be atomized flowing in a first direction;

injecting into the stream an atomizer gas in a direction generally across said first direction; and moving the stream through a progressively enlarging annulus having an interior surface so curved that the stream will flow along the contour of said interior surface without reverse eddies and without substantial turbulence; said injecting and moving steps being performed in such a manner as to cause the stream, the injected atomizer gas and said interior surface to cooperate to cause the stream to expand into a broader stream of atomized material.

2. The method of claim 1, wherein the atomizer gas is injected into the stream of material to be atomized in a direction to impart to the stream motion about an axis parallel to said first direction.

3. The method of claim 1 or 2 wherein the atomizer gas is injected into the stream of material to be atomized in a direction that forms an acute angle $\alpha$ with said first direction.

4. The method of claim 3, wherein said angle $\alpha$ is between 65 degrees and 85 degrees.

5. The method of claim 1, further comprising the step of providing a jet of control gas that surrounds the flow of the stream and that moves generally in said first direction, for controlling the breadth of the stream after moving the stream through said annulus.

6. An atomization device for atomizing coating material comprising:

channel means for transmitting a stream of material to be atomized downstream in said channel means;

funnel means downstream of said channel means and communicating therewith; said funnel means having an interior surface that expands progressively in the downstream direction of the stream to be atomized and said interior surface having a curvature moving downstream that enables the stream to flow along said surface without reversal eddies on said curvature and to form a cloud; and said funnel means having an upstream end and a downstream end; and means for injecting an atomizer gas into the stream of material to be atomized, generally across the direction of flow of the stream, for cooperating with the stream and with said interior surface of said funnel means to atomize the material.

7. The device of claim 6, wherein said gas injection means is aimed to inject atomizer gas into the stream at an angle $\alpha$ with respect to the direction of flow of the stream of between 60 degrees and 90 degrees.

8. The device of claim 7, wherein said angle $\alpha$ is between 65 degrees and 85 degrees.

9. The device of claim 8, wherein the angle $\delta$ between a plane perpendicular to the direction of flow of the stream to be atomized at said upstream end of said funnel means and said interior surface of said funnel means at said upstream end thereof is between 40 degrees and 25 degrees corresponding to the value of said angle $\alpha$ between 65 degrees and 85 degrees, and wherein the angle $\delta$ between said plane and said interior surface of said funnel means at said downstream end thereof is between 5 degrees and $2\frac{1}{2}$ degrees, corresponding to a value of said angle $\alpha$ between 65 degrees and 85 degrees.

10. The device of claim 6, wherein said atomizer gas injection means is directed to impart to the atomizer gas a component of force tending to cause the atomizer gas to rotate about an axis parallel to the direction of flow of the stream to be atomized.

11. The device of claim 6, wherein said atomizer gas injection means has an outlet aimed to inject the atomizer gas into the stream at said upstream end of said funnel means.

12. The device of claim 6, wherein said atomizer gas injection means has an outlet aimed to inject the atomizer gas into the stream within said funnel means at a point downstream from said upstream end of said funnel means.

13. The device of claim 6, wherein said gas injection means comprises slot means at said funnel means for injecting atomizer gas into the stream of atomizable material.

14. The device of claim 13, further comprising:

a first piece including said channel means for the stream of material to be atomized; and a second piece adjustably attached to said first piece and integral with at least a portion of said funnel means; said first and second pieces being positioned such that a gap is left between said first and second pieces, said gap serving as said slot means.

15. The device of claim 14, wherein said first piece is detachably secured to a source of the stream to be atomized.

16. The device of claim 14, wherein said first piece is integral with a source of the stream to be atomized.

17. The device of claim 6, further comprising means for providing a jet of a control gas to move in generally the same direction as the stream and being disposed about the periphery of said downstream end of said funnel means, whereby the shape of a cloud of atomized material produced by said device can be controlled by the jet of control gas.

18. The device of claim 6, wherein said gas injection means has an outlet aimed to inject atomizer gas in such a direction that the angle between the momentum vector of an element of the stream to be atomized immediately after injection of the atomizer gas and a tangent from the center of the stream to be atomized at the point where the atomizer gas is injected to said inner surface of said funnel means is between 6 degrees and 10 degrees.

19. The device of claim 6, further comprising means for electrostatically charging the stream to be atomized.

20. The device of claim 6, wherein said interior surface of said funnel means is made of a material selected so that friction between said interior surface of said funnel means and the stream to be atomized causes electrostatic charging of the stream to be atomized.

21. The device of claim 20, wherein, when the stream is to be atomized is comprised of an acrylic resin, said interior surface of said funnel means is polyester.

22. The device of claim 20, wherein, when the stream is to be atomized is an epoxy, said interior surface of said funnel means is a fluorocarbon.

23. The device of claim 1, wherein said gas injection means comprises outlet means located at said upstream end of said funnel means, and said device further comprising a first piece including said channel and a second means which wis detachably secured to said first piece and integral with at least a portion of said funnel means; and first and second pieces cooperating to define at least one gap between them, said at least one gap serving as said outlet means.

24. The device of claim 23, wherein said first and second pieces cooperate to define a plurality of gaps between them to serve as said outlet means.

25. The device of claim 6, wherein said gas injection means has outlet means directed toward a portion of said interior surface of said funnel means.

26. An atomization device for atomizing coating material comprising:

channel means for transmitting a stream of material to be atomized downstream in said channel means;

funnel means downstream of said channel means and communicating therewith; said funnel means having an interior surface that expands progressively in the downstream direction of the stream to be atomized and said interior surface having a curvature moving downstream that enables the stream to flow along said surface without reversal eddies on said curvature and to form a cloud;

means for injecting an atomizer gas into the stream of material to be atomized, generally across the direction of flow of the stream, said gas injection means comprising slot means at said funnel means for injecting atomizer gas into the stream;

a first piece including said channel means for the stream of material to be atomized; and a second piece adjustably attached to said first piece and integral with at least a portion of said funnel means; said first and second pieces being positioned such that a gap is left between said first and second pieces, said gap serving as said slot means.

27. The device of claim 26, wherein said first piece is detachably secured to a source of the stream to be atomized.

28. The device of claim 26, wherein said first piece is integral with a source of the stream to be atomized.

* * * * *